US009089960B2

(12) United States Patent
Wang

(10) Patent No.: US 9,089,960 B2
(45) Date of Patent: Jul. 28, 2015

(54) TOOL COMBINATION

(75) Inventor: Lo Pin Wang, Taichung (TW)

(73) Assignee: Beto Engineering & Marketing Co., Ltd., Beitun, Taichung (TW)

( * ) Notice: Subject to any disclaimer, the term of this patent is extended or adjusted under 35 U.S.C. 154(b) by 349 days.

(21) Appl. No.: 13/569,241

(22) Filed: Aug. 8, 2012

(65) Prior Publication Data

US 2014/0041128 A1 Feb. 13, 2014

(51) Int. Cl.

| | |
|---|---|
| ***B25B 23/00*** | (2006.01) |
| ***B25F 1/04*** | (2006.01) |
| ***B26B 11/00*** | (2006.01) |
| ***B25G 1/08*** | (2006.01) |

(52) U.S. Cl.
CPC . *B25F 1/04* (2013.01); *B25G 1/085* (2013.01); *B26B 11/001* (2013.01)

(58) Field of Classification Search
CPC ..... B26B 11/00; B26B 11/001; B25F 1/04; B25G 1/085; B25B 27/0071
USPC ..... 81/440, 177.4; 7/168, 128, 118
See application file for complete search history.

(56) References Cited

U.S. PATENT DOCUMENTS

| | | | | |
|---|---|---|---|---|
| 1,015,026 | A * | 1/1912 | Jackson et al. | 7/168 |
| 4,759,645 | A * | 7/1988 | Kuo | 384/396 |
| 5,267,366 | A * | 12/1993 | Frazer | 7/128 |
| 5,421,180 | A | 6/1995 | Rojdev | |
| 5,581,834 | A * | 12/1996 | Collins | 7/118 |
| 5,791,211 | A | 8/1998 | Bondhus et al. | |
| 6,279,435 | B1 * | 8/2001 | Zayat, Jr. | 81/440 |
| 6,298,756 | B1 | 10/2001 | Anderson et al. | |
| 7,810,415 | B2 * | 10/2010 | Adamany et al. | 81/440 |
| 7,900,540 | B1 * | 3/2011 | Te | 81/440 |
| 8,468,916 | B2 * | 6/2013 | Johnson et al. | 81/440 |
| 2011/0000024 | A1 * | 1/2011 | Johnson et al. | 7/118 |

* cited by examiner

*Primary Examiner* — Bryan R Muller
(74) *Attorney, Agent, or Firm* — Charles E. Baxley

(57) ABSTRACT

A tool combination includes a housing having a casing engaged in a housing and having two chambers formed in the end portions and two spaces formed in the upper and the bottom portions of the housing, one or more tool elements pivotally attached to the housing with an axle and foldable and engageable into the chambers and the spaces of the housing, and one or more tool pivotally attached to the casing and foldable and engageable into the casing with a spindle which is perpendicular to the axle for allowing many more tool elements and tool members to be received and engaged in the housing and the casing and to be easily carried and operated by the user.

5 Claims, 8 Drawing Sheets

TOOL COMBINATION

BACKGROUND OF THE INVENTION

1. Field of the Invention

The present invention relates to a tool device or assembly or combination, and more particularly to a tool device or assembly or combination including a number of tool members or tool elements pivotally or rotatably received or engaged in a carrier housing for forming a compact folding or receiving structure and for allowing much more tool members or tool elements to be easily carried and operated by the user.

2. Description of the Prior Art

Typical tool devices or assemblies or combinations comprise a number of tool members or tool elements pivotally or rotatably attached or mounted or secured to a carrier housing with a pivot shaft or axle and foldable and receivable into a receiving or engaging chamber or compartment of the carrier housing in a compact folding or receiving structure.

For example, U.S. Pat. No. 4,759,645 to Kuo, U.S. Pat. No. 5,421,180 to Rojdev, U.S. Pat. No. 5,791,211 to Bondhus et al., and U.S. Pat. No. 6,298,756 to Anderson et al. disclose several of the typical tool devices or assemblies or combinations each also comprising a carrier housing for being carried or held by the user, and a number of tool members or tool elements pivotally or rotatably attached or mounted or secured to the carrier housing and foldable and receivable or engageable into the carrier housing for forming a compact folding or receiving structure.

However, only few tool members or tool elements of few sizes or dimensions or standards may be received or engaged in the carrier housing, and the carrier housing may not provide much more tool members or tool elements for being easily carried and operated by the user.

The present invention has arisen to mitigate and/or obviate the afore-described disadvantages of the conventional tool devices or assemblies or combinations.

SUMMARY OF THE INVENTION

The primary objective of the present invention is to provide a tool device or assembly or combination including a number of tool members or tool elements pivotally or rotatably received or engaged in a carrier housing for forming a compact folding or receiving structure and for allowing much more tool members or tool elements to be easily carried and operated by the user.

In accordance with one aspect of the invention, there is provided a tool combination comprising a housing including a pair of separated and parallel plates, and a casing engaged in the housing and having a compartment formed in the casing and defined by an upper panel and a bottom panel, the upper panel and the bottom panel of the casing being straddled and secured between the plates of the housing, the housing including a first chamber formed in a first end portion of the housing, and a space formed in an upper portion of the housing and communicating with the first chamber of the housing, an axle attached to the first end portion of the housing and extended between the plates of the housing and extended through the first chamber of the housing and located outside the casing, a first tool assembly including a first tool element having a ring member engaged with the axle for pivotally attaching to the housing with the axle and for allowing the first tool element to be selectively pivoted and rotated out of the housing and to be selectively folded and engaged into the first chamber and the space of the housing, a spindle attached to the upper panel and the bottom panel of the casing and extended through the compartment of the casing and separated from the axle and perpendicular to the upper panel and the bottom panel of the casing and perpendicular to the axle, and a second tool assembly including a first tool member having a ring member engaged with the spindle for pivotally attaching to the casing with the spindle and for allowing the first tool member to be selectively pivoted and rotated out of the casing and to be selectively folded and engaged into the compartment of the casing.

The casing includes two end panels straddled and secured between the plates of the housing. The compartment of the casing is laterally opened through the plates of the housing.

The first tool assembly includes at least one second tool element having a ring member engaged with the axle for pivotally attaching to the housing with the axle and for allowing the second tool element to be selectively pivoted and rotated out of the housing and to be selectively folded and engaged into the first chamber and the space of the housing. The first tool assembly includes a washer engaged between the ring members of the first and the second tool elements.

The second tool assembly includes at least one second tool member having a ring member engaged with the spindle for pivotally attaching to the casing with the spindle and for allowing the second tool member to be selectively pivoted and rotated out of the casing and to be selectively folded and engaged into the compartment of the casing. The second tool assembly includes a washer engaged between the ring members of the first and the second tool members.

The housing includes a second chamber formed in a second end portion of the housing, and a recess formed in a bottom portion of the housing and communicating with the second chamber of the housing.

The housing includes a shaft attached to the second end portion of the housing and extended between the plates of the housing and extended through the second chamber of the housing and located outside the casing and parallel to the axle.

The housing includes a third tool assembly having a third tool element which includes a ring member engaged with the shaft for pivotally attaching to the housing with the shaft and for allowing the third tool element to be selectively pivoted and rotated out of the housing and to be selectively folded and engaged into the second chamber and the recess of the housing.

The third tool assembly includes at least one fourth tool element having a ring member engaged with the shaft for pivotally attaching to the housing with the shaft and for allowing the fourth tool element to be selectively pivoted and rotated out of the housing and to be selectively folded and engaged into the second chamber and the recess of the housing.

The casing includes a pivot rod attached to the upper panel and the bottom panel of the casing and extended through the compartment of the casing and perpendicular to the upper panel and the bottom panel of the casing and perpendicular to the axle and parallel to the spindle.

The casing includes a fourth tool assembly having a third tool member which includes a ring member engaged with the pivot rod for pivotally attaching to the casing with the pivot rod and for allowing the third tool member to be selectively pivoted and rotated out of the casing and to be selectively folded and engaged into the compartment of the casing.

The fourth tool assembly includes at least one fourth tool member having a ring member engaged with the pivot rod for pivotally attaching to the casing with the pivot rod and for allowing the fourth tool member to be selectively pivoted and rotated out of the casing and to be selectively folded and engaged into the compartment of the casing.

The casing includes a partition provided in the compartment of the casing for separating the first and the third tool members from each other.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
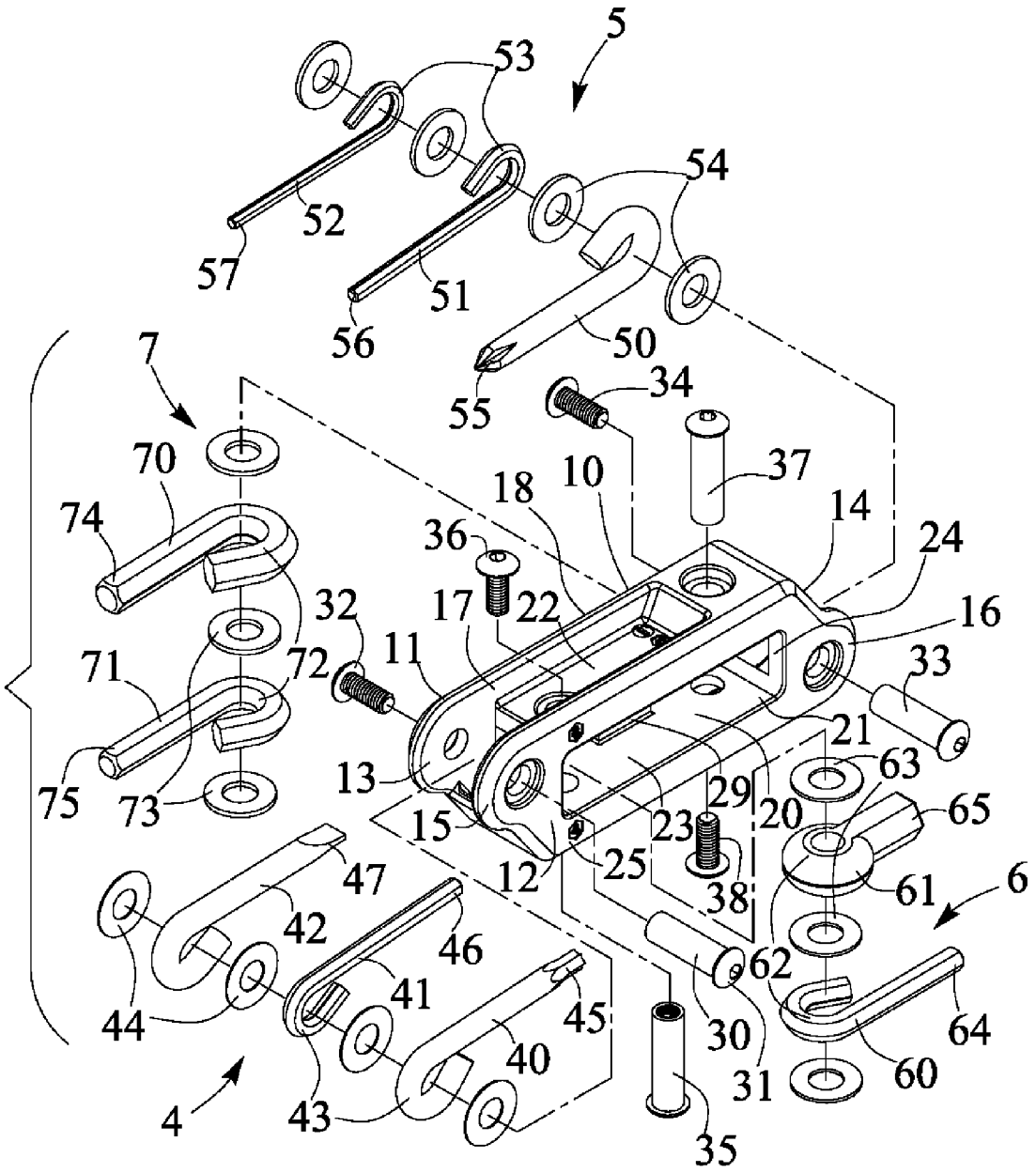
FIG. 1 is an exploded view of a tool device or assembly or combination in accordance with the present invention.

Referring to the drawings, and initially to FIGS. 1-7, a tool device or assembly or combination in accordance with the present invention comprises a carrier housing 10 including a pair of separated and parallel panels or plates 11, 12, and a casing 20 disposed or attached or mounted or secured or received or engaged in the carrier housing 10 and having a compartment 21 formed in the casing 20 and formed or defined by an upper wall or panel 22, a bottom wall or panel 23 and two end walls or panels 24, in which the upper panel 22 and the bottom panel 23 and the end panels 24 of the casing 20 are straddled and secured or coupled between the plates 11, 12 of the housing 10, and the compartment 21 of the casing 20 is laterally opened through the plates 11, 12 of the housing 10.

The upper panel 22 and the bottom panel 23 and the end panels 24 of the casing 20 include a size or dimension or standard or width or height or volume or area smaller than that of the housing 10 for forming or defining a chamber 13, 14 in each of the end portions 15, 16 of the housing 10, a space 17 in the upper portion 18 of the housing 10, and a cavity or depression or recess 19 in the bottom portion 25 of the housing 10, in which the chambers 13, 14 and the space 17 and the recess 19 of the housing 10 are formed and located out or around the casing 20 and offset or separated from the compartment 21 of the casing 20 by the upper panel 22 and the bottom panel 23 and the end panels 24 of the casing 20. It is preferable that the space 17 is communicating with the chamber 13 at one end or first end portion 15 of the housing 10, and the recess 19 is communicating with the chamber 14 at the other end or second end portion 16 of the housing 10.

A spindle or shaft or axle 30 is attached or mounted or secured to the one end or first end portion 15 of the housing 10 and extended or straddled and coupled between the plates 11, 12 of the housing 10 and extended through the chamber 13 and/or the space 17 of the housing 10, and located outside the casing 20, and includes an enlarged head 31 formed or provided on one end portion thereof for engaging with one of the plates 12 of the housing 10, and includes a fastener 32 attached or mounted or secured to the other end portion thereof for engaging with the other plate 11 and for solidly and stably anchoring or retaining or locking or securing the axle 30 to the plates 11, 12 of the housing 10. Another spindle or axle or shaft 33 is attached or mounted or secured to the other end or second end portion 16 of the housing 10 with a fastener 34 and extended through the chamber 14 and/or the recess 18 of the housing 10, and extended or straddled and coupled between the plates 11, 12 of the housing 10 and located outside the casing 20 and parallel to the axle 30.

An axle or shaft or spindle 35 is attached or mounted or secured to the upper panel 22 and the bottom panel 23 of the casing 20 with a fastener 36, and extended through the compartment 21 of the casing 20, and located closer to the one end or first end portion 15 of the housing 10 and offset or separated from the axle 30 and perpendicular to the upper panel 22 and the bottom panel 23 of the casing 20, and also perpendicular to the shaft 33 and the axle 30. An axle or shaft or spindle or pivot rod 37 is also attached or mounted or secured to the upper panel 22 and the bottom panel 23 of the casing 20 with a fastener 38, and extended through the compartment 21 of the casing 20, and located closer to the other end or second end portion 16 of the housing 10 and offset or separated from the shaft 33 and perpendicular to the upper panel 22 and the bottom panel 23 of the casing 20, and also perpendicular to the shaft 33 and the axle 30 and parallel to the spindle 35.

Figure 2:
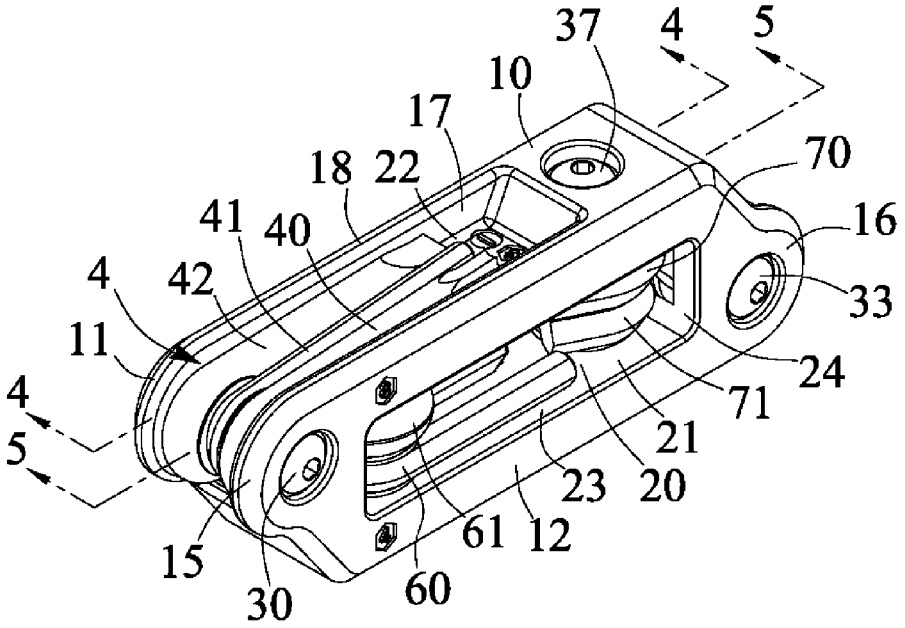
FIG. 2 is an upper perspective view of the tool device or assembly or combination.
Figure 3:
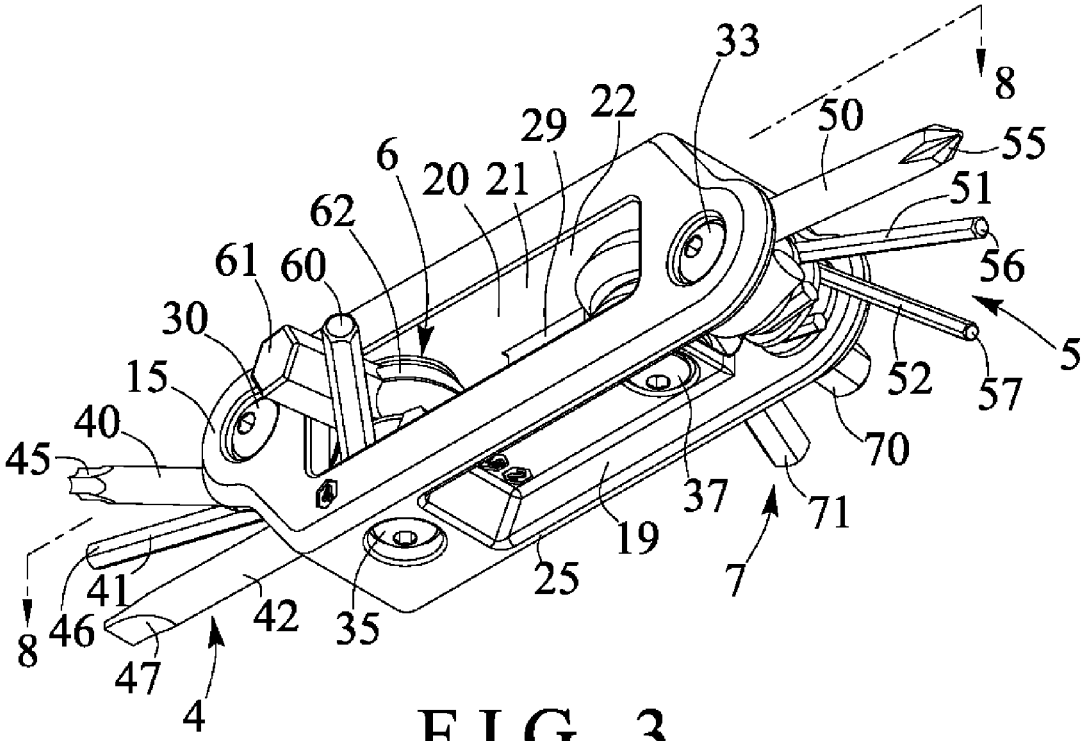
FIG. 3 is a bottom perspective view of the tool device or assembly or combination, illustrating the operation of the tool device or assembly or combination.
Figure 4:
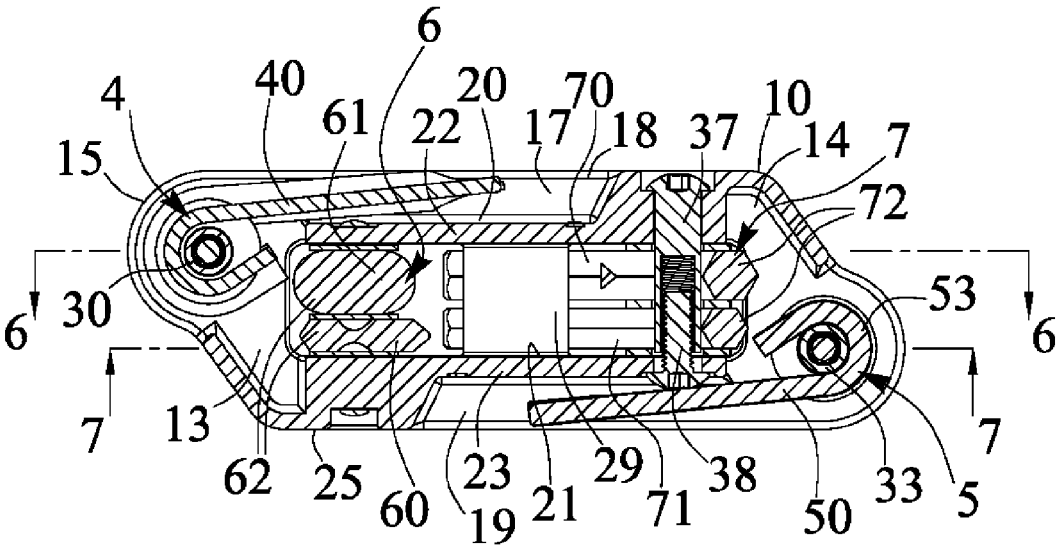
FIGS. 4, 5 are cross sectional views of the tool device or assembly or combination, taken along lines 4-4 and 5-5 of FIG. 2 respectively.
Figure 5:
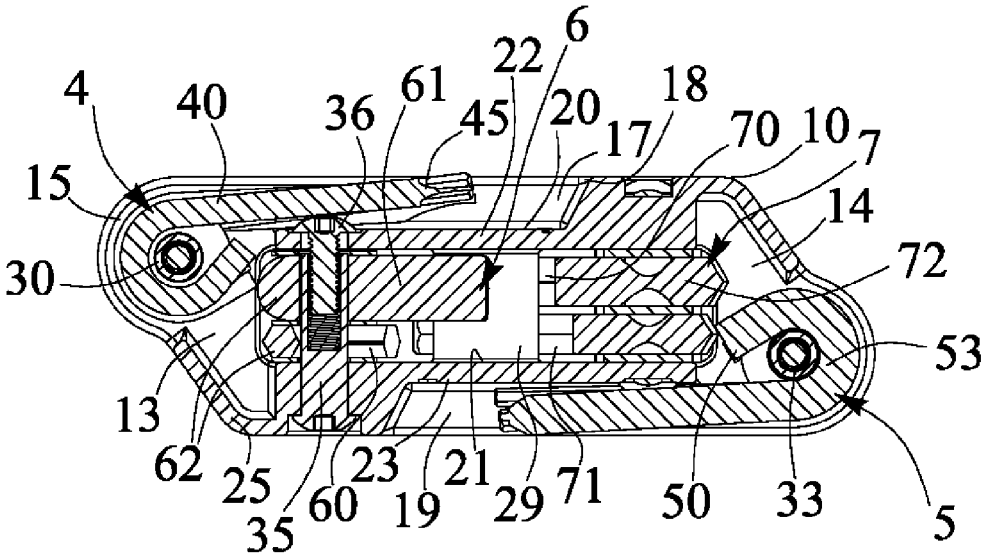
Figure 8:
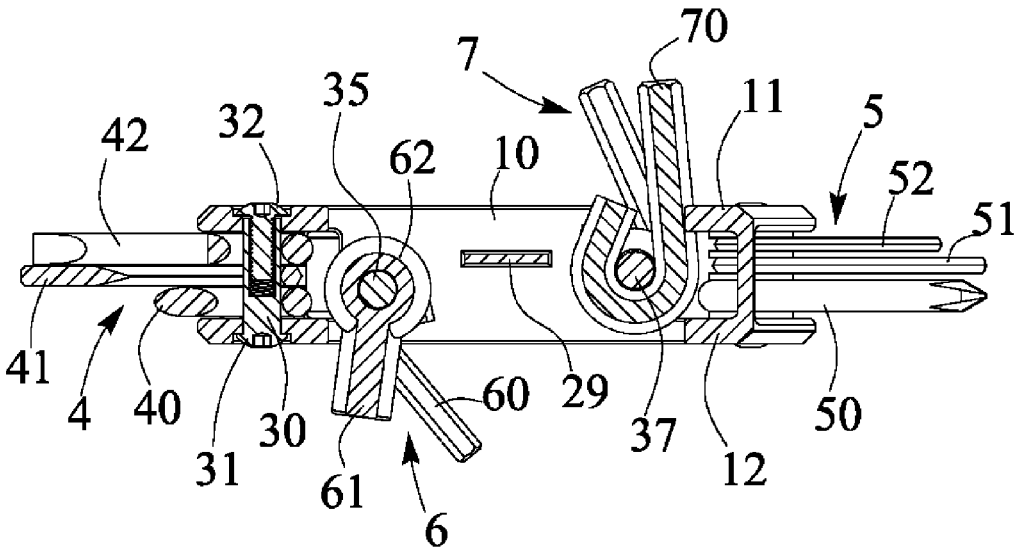
FIG. 8 is a cross sectional view of the tool device or assembly or combination, taken along lines 8-8 of FIG. 3.
Figure 9:
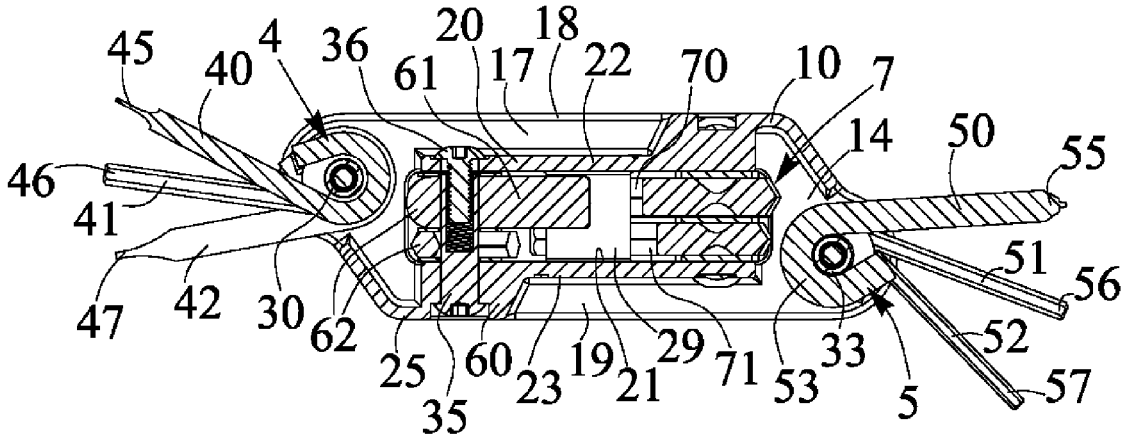
FIG. 9 is a cross sectional view similar to FIG. 5, illustrating the operation of the tool device or assembly or combination.
Figure 10:
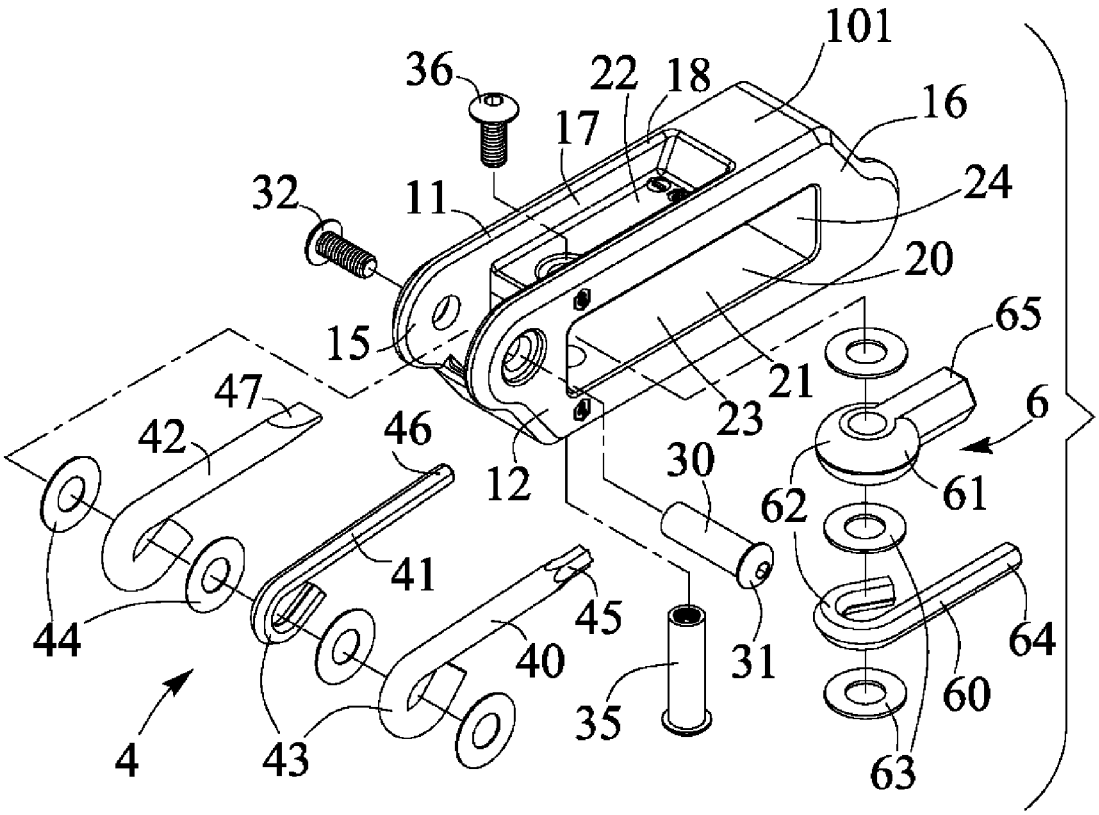
FIG. 10 is an exploded view similar to FIG. 1, illustrating the other arrangement of the tool device or assembly or combination.

A first tool device or assembly 4 includes one or more tool members or tool elements 40, 41, 42 each having a loop or ring member 43 for engaging with the axle 30 and for pivotally or rotatably attaching or mounting or securing the tool elements 40-42 to the housing 10 with the axle 30, and one or more spacers or washers 44 are disposed or attached or mounted and engaged between the ring members 43 of the tool elements 40-42 for suitably separating the tool elements 40-42 from each other and for allowing the tool elements 40-42 to be smoothly pivoted or rotated relative to the housing 10 and to be selectively pivoted or rotated out of the housing 10 (FIGS. 3, 8-9) or to be selectively pivoted or rotated or folded or stored or received or engaged into the chamber 13 and/or the space 17 of the housing 10 (FIGS. 2, 4-5). The tool elements 40-42 may include tips or tool portions 45, 46, 47 of different sizes or shapes or contours or dimensions or standards.

Figure 6:
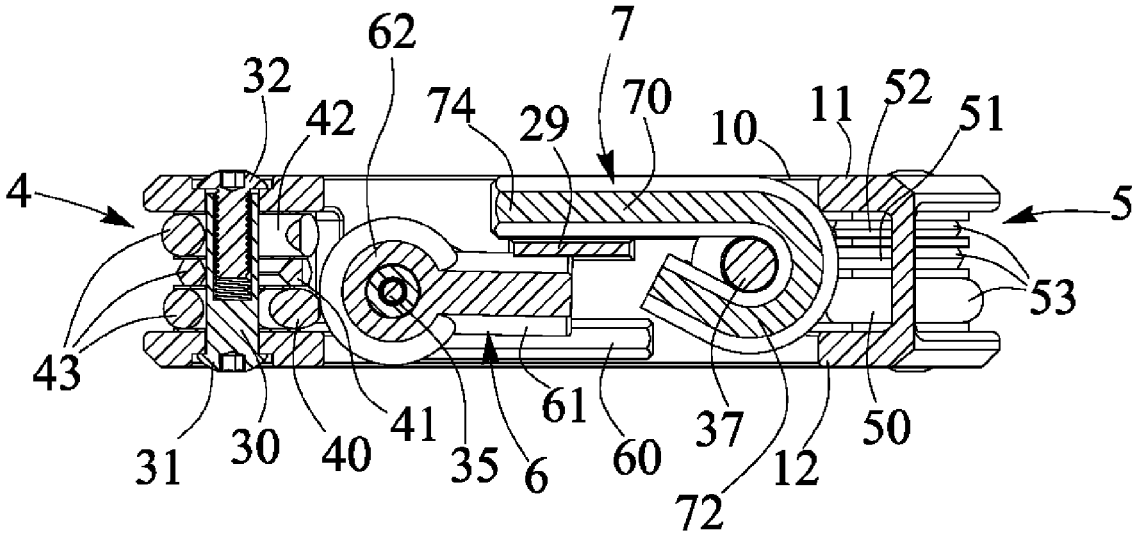
FIGS. 6, 7 are cross sectional views of the tool device or assembly or combination, taken along lines 6-6 and 7-7 of FIG. 4 respectively.
Figure 7:
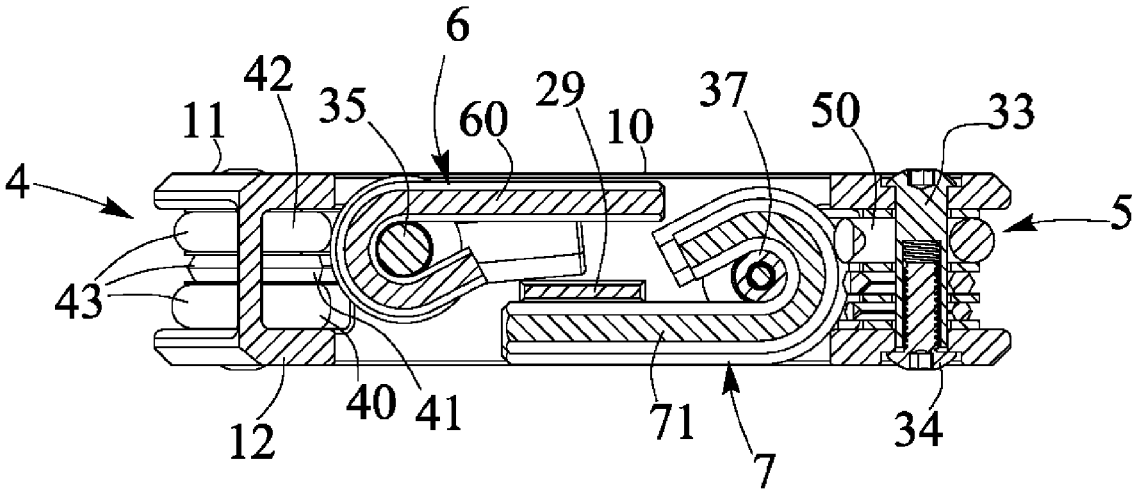

A second tool device or assembly 6 includes one or more tool elements or tool members 60, 61 each having a loop or ring member 62 for engaging with the spindle 35 and for pivotally or rotatably attaching or mounting or securing the tool members 60-61 to the casing 20 with the spindle 35, and one or more spacers or washers 63 are disposed or attached or mounted and engaged between the ring members 62 of the tool members 60-61 for suitably separating the tool members 60-61 from each other and for allowing the tool members 60-61 to be smoothly pivoted or rotated relative to the casing 20 and to be selectively pivoted or rotated out of the casing 20 (FIGS. 3, 8) or to be selectively pivoted or rotated or folded or stored or received or engaged into the compartment 21 of the casing 20 (FIGS. 6, 7). The tool members 60-61 may include tips or tool portions 64, 65 of different sizes or shapes or contours or dimensions or standards.

A third tool device or assembly 5 includes one or more tool members or tool elements 50, 51, 52 each having a loop or ring member 53 for engaging with the shaft 33 and for pivotally or rotatably attaching or mounting or securing the tool elements 50-52 to the housing 10 with the shaft 33, and one or more spacers or washers 54 are disposed or attached or mounted and engaged between the ring members 53 of the tool elements 50-52 for suitably separating the tool elements 50-52 from each other and for allowing the tool elements 50-52 to be smoothly pivoted or rotated relative to the housing 10 and to be selectively pivoted or rotated out of the housing 10 (FIGS. 3, 8-9) or to be selectively pivoted or rotated or folded or stored or received or engaged into the chamber 14 and/or the recess 19 of the housing 10 (FIGS. 4, 5). The tool elements 50-52 may include tips or tool portions 55, 56, 57 of different sizes or shapes or contours or dimensions or standards.

A fourth tool device or assembly 7 includes one or more tool elements or tool members 70, 71 each having a loop or ring member 72 for engaging with the pivot rod 37 and for pivotally or rotatably attaching or mounting or securing the tool members 70-71 to the casing 20 with the pivot rod 37, and one or more spacers or washers 73 are disposed or attached or mounted and engaged between the ring members 72 of the tool members 70-71 for suitably separating the tool members 70-71 from each other and for allowing the tool members 70-71 to be smoothly pivoted or rotated relative to the casing 20 and to be selectively pivoted or rotated out of the casing 20 (FIG. 8) or to be selectively pivoted or rotated or folded or stored or received or engaged into the compartment 21 of the casing 20 (FIGS. 6, 7). The tool members 70-71 may include tips or tool portions 74, 75 of different sizes or shapes or contours or dimensions or standards.

Figure 11:
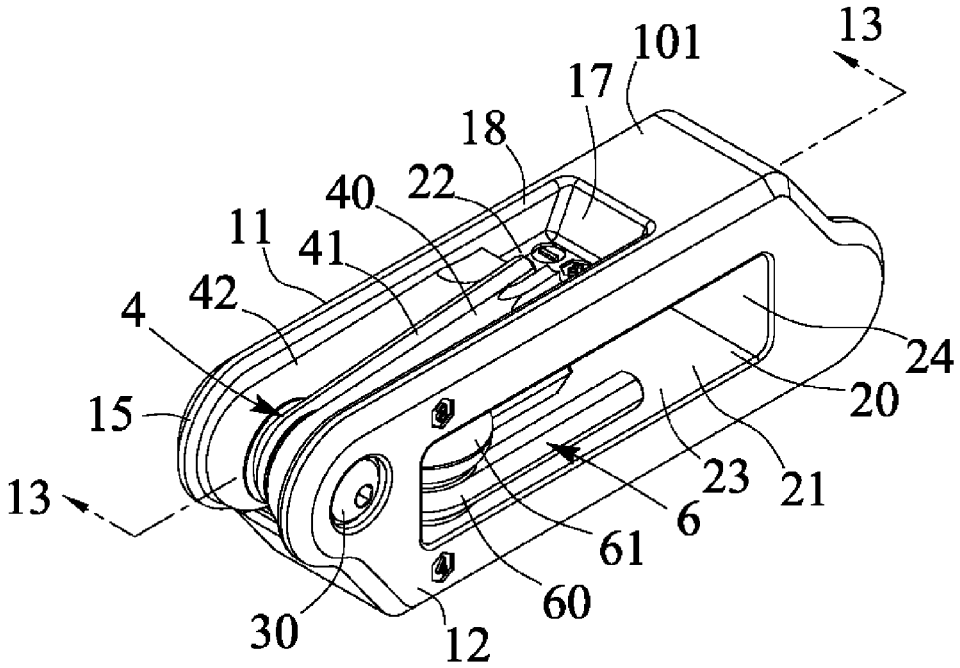
FIG. 11 is an upper perspective view of the tool device or assembly or combination as shown in FIG. 10.
Figure 12:
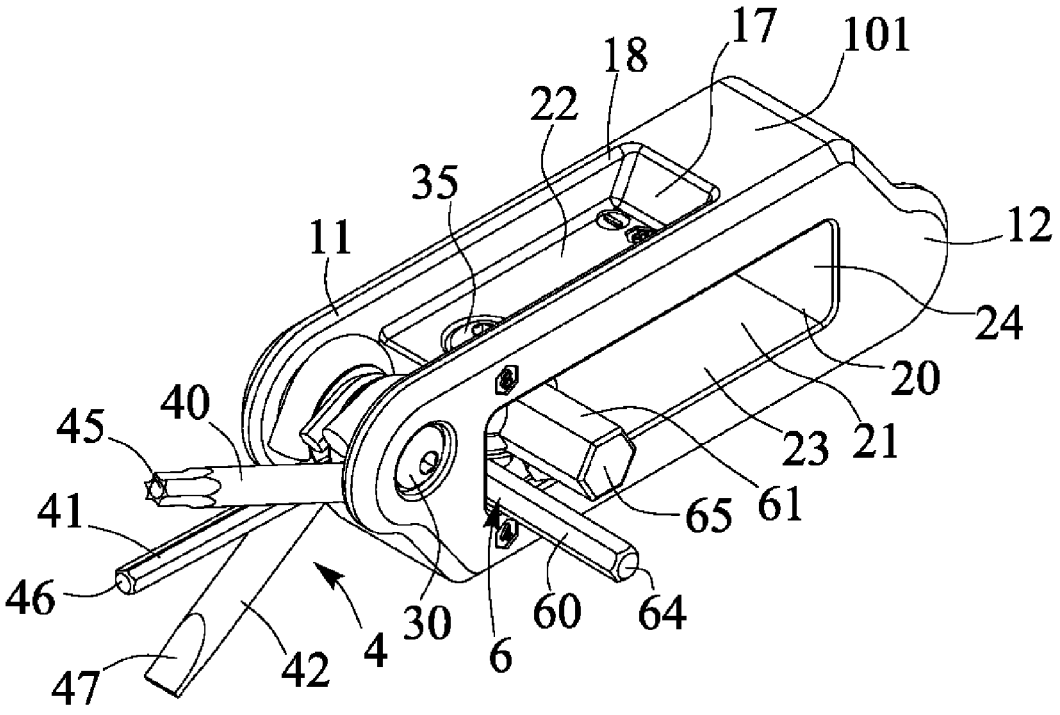
FIG. 12 is another upper perspective view similar to FIG. 11, illustrating the operation of the tool device or assembly or combination as shown in FIGS. 10-11.
Figure 13:
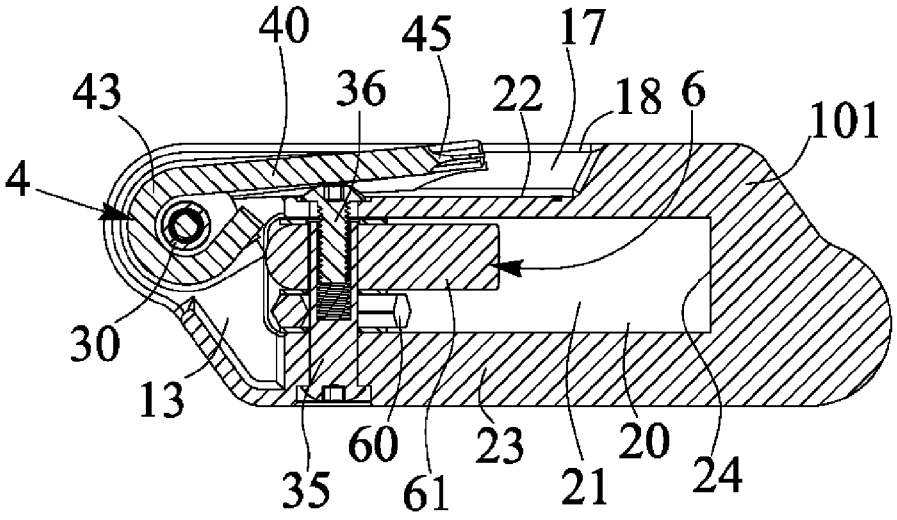
FIG. 13 is a cross sectional view of the tool device or assembly or combination, taken along lines 13-13 of FIG. 11.
Figure 14:
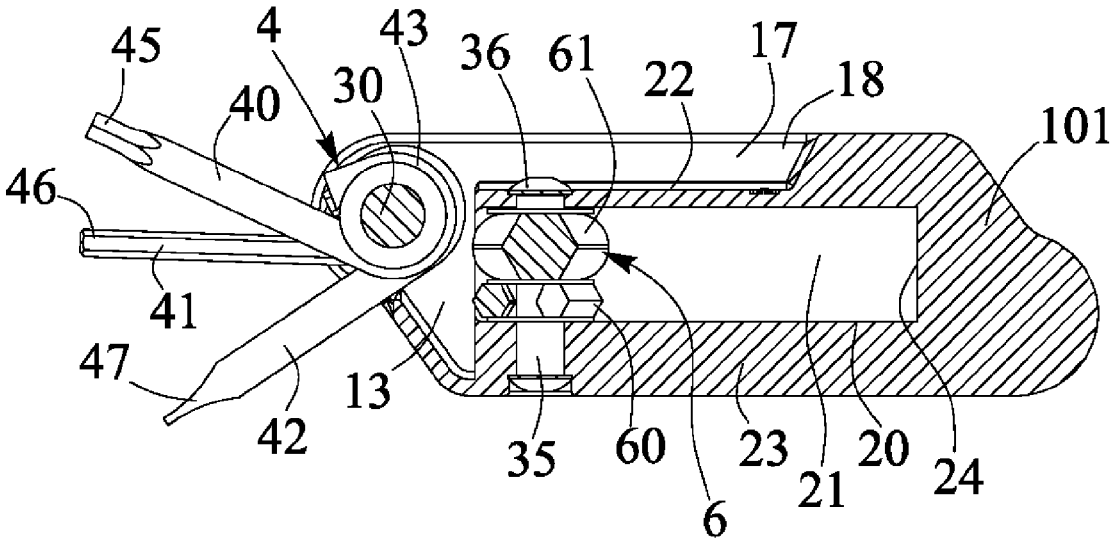
FIG. 14 is a cross sectional view similar to FIG. 13, illustrating the operation of the tool device or assembly or combination as shown in FIGS. 10-13.

Alternatively, as shown in FIGS. 10-14, the housing 101 may include only the first tool device or assembly 4 having the tool elements 40-42 pivotally or rotatably attached or mounted or secured to the housing 101 with the axle 30, and to be selectively pivoted or rotated out of the housing 101 (FIGS. 12, 14) or to be selectively pivoted or rotated or folded or stored or received or engaged into the chamber 13 and/or the space 17 of the housing 101 (FIGS. 11, 13), and the second tool device or assembly 6 having the tool members 60-61 pivotally or rotatably attached or mounted or secured to the casing 20 with the spindle 35, and to be selectively pivoted or rotated out of the casing 20 (FIG. 12) or to be selectively pivoted or rotated or folded or stored or received or engaged into the compartment 21 of the casing 20 (FIG. 11).

It is to be noted that the axle 30 is perpendicular to the spindle 35 and the pivot rod 37 and parallel to the shaft 33, and the spindle 35 is perpendicular to the shaft 33 and the axle 30 and parallel to the pivot rod 37, and the tool elements 40-42 of the first tool device or assembly 4 may be folded or stored or received or engaged into the chamber 13 and/or the space 17 of the housing 10, and the tool elements 50-52 of the third tool device or assembly 5 may be folded or stored or received or engaged into the chamber 14 and/or the recess 19 of the housing 10, and the tool members 60-61, 70-71 of the second and the fourth tool devices or assemblies 6, 7 may be folded or stored or received or engaged into the compartment 21 of the casing 20 such that the tool combination may include many more tool members or tool elements to be easily carried and operated by the user. The housing 10 and/or the casing 20 may include a spacer or partition 29 formed or provided in the compartment 21 of the casing 20 for suitably separating the tool members 60-61, 70-71 from each other.

Accordingly, the tool combination in accordance with the present invention includes a number of tool members or tool elements pivotally or rotatably received or engaged in a carrier housing for forming a compact folding or receiving structure and for allowing many more tool members or tool elements to be easily carried and operated by the user.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tool combination comprising:

a housing including a pair of separated and parallel plates, and a casing engaged in said housing and having a compartment formed in said casing and defined by an upper panel and a bottom panel, said upper panel and said bottom panel of said casing being straddled and secured between said plates of said housing, said housing including a first chamber formed in a first end portion of said housing, and a space formed in an upper portion of said housing and communicating with said first chamber of said housing, said housing including a second chamber formed in a second end portion of said housing, and a recess formed in a bottom portion of said housing and communicating with said second chamber of said housing, said casing including two end panels straddled and secured between said plates of said housing, and said compartment of said casing being laterally opened through said plates of said housing, an axle attached to said first end portion of said housing and extended between said plates of said housing and extended through said first chamber of said housing and located outside said casing, said housing including a shaft attached to said second end portion of said housing and extended between said plates of said housing and extended through said second chamber of said housing and located outside said casing and parallel to said axle, a first tool assembly including a first tool element having a ring member engaged with said axle for pivotally attaching to said housing with said axle and for allowing said first tool element to be selectively pivoted and rotated out of said housing and to be selectively folded and engaged into said first chamber and said space of said housing, said first tool assembly including at least one second tool element having a ring member engaged with said axle for pivotally attaching to said housing with said axle and for allowing said at least one second tool element to be selectively pivoted and rotated out of said housing and to be selectively folded and engaged into said first chamber and said space of said housing, and said first tool assembly including a washer engaged between said ring members of said first and said at least one second tool elements, a spindle attached to said upper panel and said bottom panel of said casing and extended through said compartment of said casing and separated from said axle and perpendicular to said upper panel and said bottom panel of said casing and perpendicular to said axle, and a second tool assembly including a first tool member having a ring member engaged with said spindle for pivotally attaching to said casing with said spindle and for allowing said first tool member to be selectively pivoted and rotated out of said casing and to be selectively folded and engaged into said compartment of said casing, said second tool assembly including at least one second tool member having a ring member engaged with said spindle for pivotally attaching to said casing with said spindle and for allowing said at least one second tool member to be selectively pivoted and rotated out of said casing and to be selectively folded and engaged into said compartment of said casing, and said second tool assembly including a washer engaged between said ring members of said first and said at least one second tool members, and said housing including a third tool assembly having a third tool element which includes a ring member engaged with said shaft for pivotally attaching to said housing with said shaft and for allowing said third tool element to be selectively pivoted and rotated out of said housing and to be selectively folded and engaged into said second chamber and said recess of said housing, said third tool assembly including at least one fourth tool element having a ring member engaged with said shaft for pivotally attaching to said housing with said shaft and for allowing said at least one fourth tool element to be selectively pivoted and rotated out of said housing and to be selectively folded and engaged into said second chamber and said recess of said housing.

2. The tool combination as claimed in claim 1, wherein said casing includes a pivot rod attached to said upper panel and said bottom panel of said casing and extended through said compartment of said casing and perpendicular to said upper panel and said bottom panel of said casing and perpendicular to said axle and parallel to said spindle.

3. The tool combination as claimed in claim 2, wherein said casing includes a fourth tool assembly having a third tool member which includes a ring member engaged with said pivot rod for pivotally attaching to said casing with said pivot rod and for allowing said third tool member to be selectively pivoted and rotated out of said casing and to be selectively folded and engaged into said compartment of said casing.

4. The tool combination as claimed in claim 3, wherein said fourth tool assembly includes at least one fourth tool member having a ring member engaged with said pivot rod for pivotally attaching to said casing with said pivot rod and for allowing said at least one fourth tool member to be selectively pivoted and rotated out of said casing and to be selectively folded and engaged into said compartment of said casing.

5. The tool combination as claimed in claim 3, wherein said casing includes a partition provided in said compartment of said casing for separating said first and said third tool members from each other.

* * * * *